United States Patent [19]

Forbes

[11] 4,381,989

[45] May 3, 1983

[54] METHOD OF AND APPARATUS FOR THE MIXING AND PROCESSING OF FRAGILE MATERIAL AND FRAGMENTED SOLIDS

[75] Inventor: Frank Forbes, Lakewood, Colo.

[73] Assignee: Dravo Corporation, Pittsburgh, Pa.

[21] Appl. No.: 322,771

[22] Filed: Nov. 19, 1981

[51] Int. Cl.[3] ..... C10B 53/06; C10B 37/00

[52] U.S. Cl. ..... 208/11 R; 201/40; 201/32; 198/540

[58] Field of Search ..... 208/8 R, 11 R; 201/32, 201/40, 6; 198/540

[56] References Cited

U.S. PATENT DOCUMENTS

| | | | |
|---|---|---|---|
| 1,906,755 | 5/1933 | Karrick | 201/40 X |
| 1,918,162 | 7/1933 | Willson | 201/40 X |
| 3,179,391 | 4/1965 | Connell | 208/11 R X |
| 3,260,513 | 7/1966 | Connell | 208/11 R |
| 3,560,368 | 2/1971 | Rowland et al. | 201/40 X |
| 4,039,427 | 8/1977 | Ban | 201/40 X |
| 4,156,595 | 5/1977 | Scott et al. | 201/40 X |
| 4,193,862 | 3/1980 | Ban et al. | 208/11 R |

*Primary Examiner*—Delbert E. Gantz
*Assistant Examiner*—Glenn A. Caldarola
*Attorney, Agent, or Firm*—Parmelee, Miller, Welsh & Kratz

[57] ABSTRACT

Fragile agglomerates with crushed rock fragments, such as fines which are subsequently agglomerated and which result in the crushing of rock fragments, such as oil shale prepared for retorting are mixed and delivered onto conveying means, such as a travelling grate by charging the rock fragments into a bin which delivers through a choke-feed onto the conveyor or travelling grate by introducing the agglomerates through a series of space conducts or tubes terminating inside the bin below the level of the lump material or fragments in the bin where the rock fragments have a downward travel such as to enable the aggregates to defuse from the ends of the spaced pipes into and through the fragments and while so separated and diffused through the fragments move with the fragments onto the grate.

5 Claims, 3 Drawing Figures

METHOD OF AND APPARATUS FOR THE MIXING AND PROCESSING OF FRAGILE MATERIAL AND FRAGMENTED SOLIDS

This invention is for the processing together of hard solid fragments of rock-like material and fragile bodies, such as agglomerates of small pieces and particles, such as the fines resulting from the crushing of said rock-like material into fragments.

The invention is particularly applicable to, but is not confined to, the extraction of oil from oil shale where the shale as mined is reduced to fragments that are continuously fed onto a travelling grate where they are retorted by the passage of hot gases upwardly or downwardly therethrough one or more times. In reducing the shale, as mined, to fragments of the desired size a considerable percentage of the shale may be unavoidably reduced to fines, perhaps of screen mesh size of $\frac{1}{4}$ or $\frac{3}{8}''$ and under. These fines must be removed by screening since their presence on the grate tends to block the maze of passages between the fragments against the effective flow of gases therethrough. At the same time the percentage of fines is sufficiently high that they cannot be economically discarded. They may be agglomerated and the agglomerates distilled for the extraction of oil, but being fragile as compared to the fragments of broken shale, processing the agglomerates along with the fragments on the travelling grate results in excessive breakage. This breakage of the agglomerates occurs principally in the mixing, loading and distributing the load over the grate, since once the load is arranged on the bed there is little or no further relative motion between the lumps and fragments of consequence.

To eliminate fines from the crushed shale, they are commonly removed by screening, not uncommonly by passage over an inclined screen as they move by gravity into a hopper from the bottom of which the screened fragments, generally free of fines are deposited onto the travelling grate. For this purpose the hopper tapers toward the bottom to a restricted bottom opening of a chute-like form that directs the material onto the grate in the direction of its travel with the bottom transverse edge of the hopper outlet across the width of the grate on the downstream side being above the grate at level which controls the depth of the layer of material loaded onto the continuous grate from the hopper. Hoppers may be arranged with two in tandem, or even more, so that each succeeding hopper deposits one layer over the preceding one until the desired finished depth is reached. This arrangement is known in the art as a "choke-fed" bin system and the upper plate of the discharge or downstream outlet from the bin is termed the "cut-off plate", all of which is shown in the drawings hereinafter referred to.

The fines may commonly range from 6–8% to as much as 25 to 50% by weight of the total raw material in the feed stream. They may be agglomerated by any one of several different processes, as pelletizing, briquetting, extrusion, compacting, etc., but the problem remains, because of the fragile nature of the agglomerates of how they may then be retorted.

Because of the need for sealing provisions on the retort due to hazardous recycle of combustible gases, normal travelling grate feed systems are not applicable to shale oil agglomerates. Because of their fragile nature they cannot be directly loaded and withdrawn from a choke-fed bin with conventional cut-off plates used for feeding travelling grates with oil shale fragments, as impact and shear against the cut-off plates would cause too extensive degredation. Presently, they are not processed simultaneously with the sized fragments.

BRIEF DESCRIPTION OF THE PRESENT INVENTION

The present invention is for a process and apparatus for the simultaneous retorting of the agglomerates with the solid fragments by random diffusion of the two into a common mass, at a level below the normal level of incoming shale fragments into the bin or the impact of such incoming mass, preferably with a lesser volume of aggregates to fragments in the feed bin whereby the "bridging" of the solids around the agglomerates provides substantial protection against crushing or extensive degredation by crushing or excessive fragmentation of the agglomerates, sometimes herein referred to also as "compacts" as they are delivered onto the grate from the choke-fed bin, and beneath the cut-off plate.

The invention may be more fully understood by reference to the accompanying drawings wherein.

Figure 3:
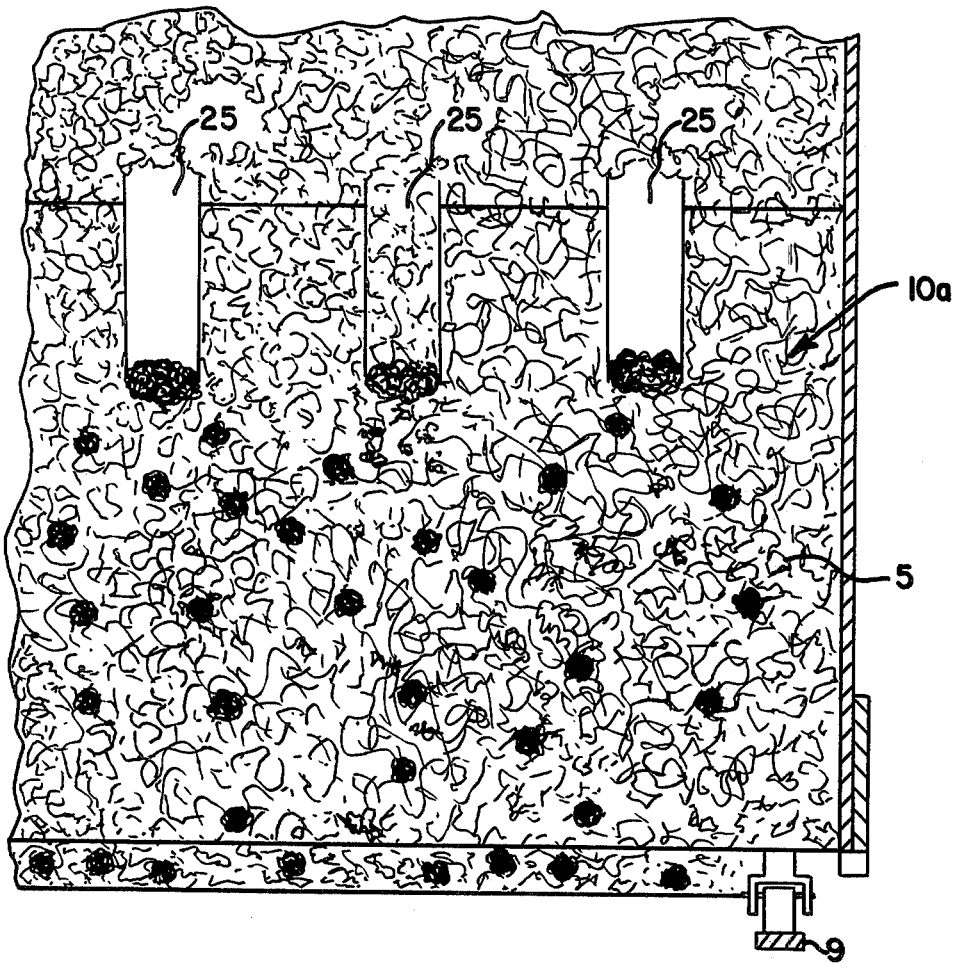

FIG. 3 is a fragmentary transverse section on a larger scale indicating a portion of the choke-fed bin arrangement and agglomerate discharge pipes by means of which the compacts are diffused through the solid fragments, and in a small area of the bin, the heavily or black shaded bodies indicating the compacts and the unshaded ones the fragments, the figure being simply illustrative without attempting to indicate proportions.

Figure 1:
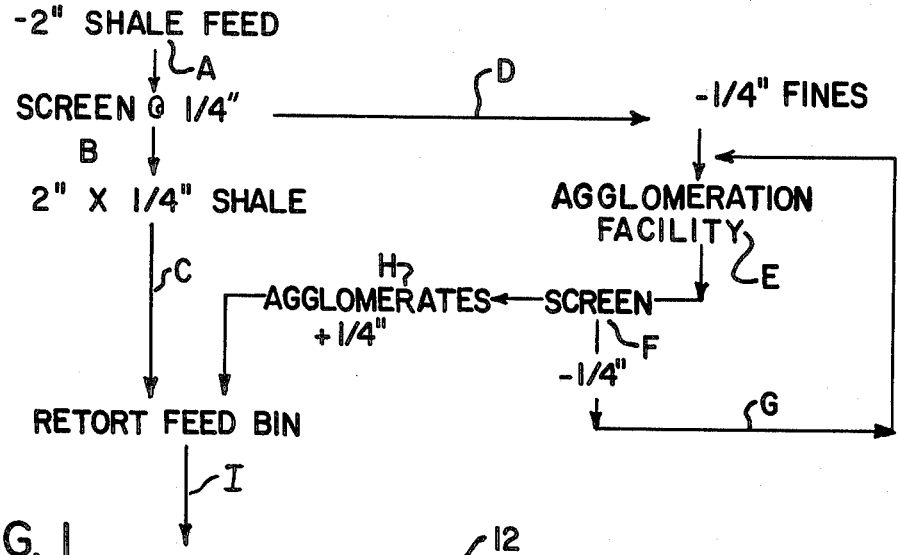
FIG. 1 is a flow-diagram of a shale-oil retort feed system for the combined retorting or distillation of mixed oil shale solids and aggregates as where the mixing is effected by the process of this invention.

Referring first to FIG. 1, it is a schematic diagram, simplified to illustrate the overall operation, wherein shale which has been crushed into fragments in the usual manner, and having been once screened to separate over-size pieces, for example pieces too large to pass through a two inch mesh screen. The two inch pieces and smaller, including fines from this first screening operation are again screened as indicated at A to separate the fines from the lumps. For example, pieces $\frac{1}{4}$ inch maximum size and smaller, which pass a $\frac{1}{4}$ inch mesh screen, are herein collectively referred to as "fines". The coarse material, designated on the drawing as $2'' \times \frac{1}{4}''$ shale are directed, as indicated by B into a feed bin to the travelling grate, indicated by arrow C. The fines are delivered to an agglomerating facility and the agglomerated material is discharged onto screen E. Unagglomerated material and undersized agglomerated material that are screened out in this operation are recycled to D, as indicated by arrow F. The agglomerates are discharged into the feed bin to mix with the lump-shale entering the feed bin, as described. It is to this phase of the process that the present invention primarily relates.

Figure 2:
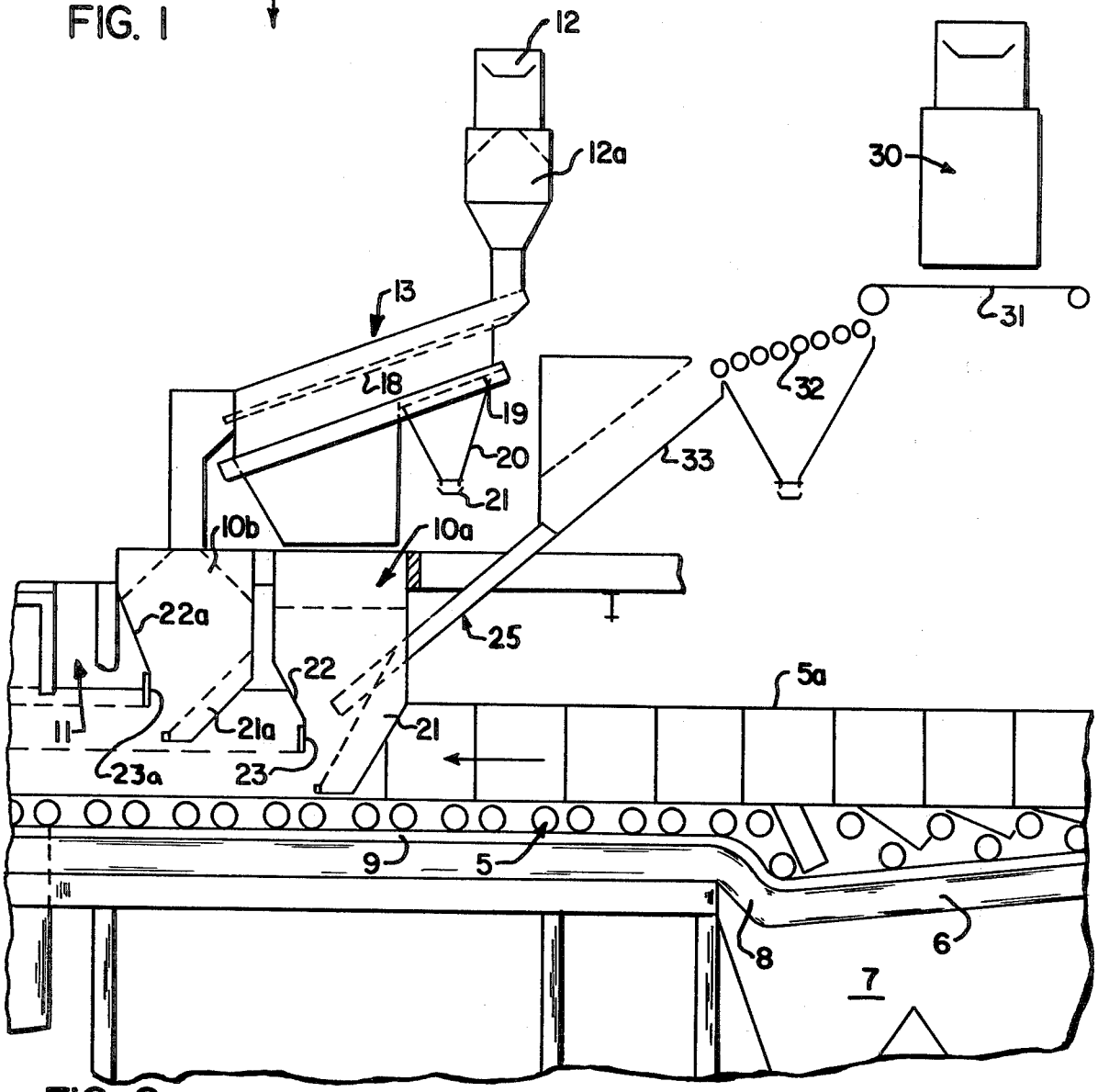
FIG. 2 is a schematic vertical section through a feed system for the practice of the invention, the section being a longitudinal section along the length of a portion of the travelling grate and the grate loading elements but with at least most of any fixed framing or supporting structure removed.

Referring now to FIG. 2, 5 designates a continuous travelling grate, only a portion of which, emerging from the discharge end of the retort not shown, moves along a grate dumping station 6 where the bottoms of the continuous succession of trays or sections open downwardly to discharge the ash and spent agglomerates into removal hoppers 7 after which these bottoms ride in succession up an incline 8 to a normal level of travel on track 9 beneath the charging means, which is here shown as comprising two bins, 10*a* and 10*b*, the latter being immediately adjacent the former, and following which the grate sections move into and through the retorting or distillation process. The entering end of the retort is indicated at 11. With respect to the direction of travel of the grate, 10*b* is downstream, or to the left of 10*a* as viewed in FIG. 2.

Crushed oil shale from the crusher and having been once screened to eliminate over size pieces, not shown, is delivered by conveyor 12 to a receiving bin 12*a* from which it is discharged into chute 13 having an upper screen 18 (corresponding to A in FIG. 1) over which the shale gravitates with smaller lumps and fines falling through the screen to the bottom of the chute. The upper portion of the chute bottom, designated 19 (corresponding to B in FIG. 1), comprises a finer screen than 18 through which fines, for example, particles $\frac{1}{4}$ inches maximum dimension in any direction, will fall into shale-fines removal hopper 20 to be carried by conveyor 21 to an agglomerating facility, not shown, at 30. It may be one of several types, including the forming of pellets, briquettes, extrusions and compacts being among the more generally used methods. It corresponds to E in FIG. 1.

With this arrangement, the coarser fragments are discharged into sized feed bin 10*b* and the smaller and less coarse fragments are discharged into sized feed bin 10*a*. While two bins in tandem are preferred, there could be only a single bin in place of these two. Each bin is of the familiar choke-feed type wherein the forward, or upstream transverse wall of the bin 10*a* is extended downwardly and rearwardly with reference to the direction of travel of the grate to the lowermost level of discharge of material from the bin onto the grate. This wall, 21, with side wings indicated by broken lines, for example, extends down sufficiently to just clear the upper surface of the travelling grate 5. The corresponding wall of the hopper 10*b* is designated 21*a* and extends to a level that is approximately midway between the bottom of the grate and its upper side edges 5*a*.

The bin 10*a* has an inclined rear wall 22, confronting but spaced from the wall 21, terminating in a vertical cut-off plate 23 the lower edge of which is at a level about halfway between the bottom and top edge of the grate, but slightly below the lower end of 21*a* of bin 10*b*. Bin 10*b* has correspondingly sloped rear wall 22*a*, terminating in a vertical cut-off plate 23*a*, the lower edge of which is at a level near to, but extending slightly down between the sides of the travelling grate, that is to a level slightly below the plane of the top edges of the grate. This narrowing down of the hopper bottoms to discharge material downwardly and forwardly to a limited depth is well known in the conveyor art and is known as the "choke-feed and cut-off", and in the present instance the first layer is deposited on the grate from bin 10*a* grate to a depth around half the full depth of the grate and the second layer, from hopper 10*b* then falls within practical limits, to a level with the tops of the side edges of the grate, 5*a*.

This apparatus, so far as it has been described in FIG. 2 is applicable to the retorting of oil shale, but may not be used for the distillation of the compacts or aggregates which undergo excessive breaking and shattering in the mass movement and choke-feed and cut-off, including excessive shearing of the formed aggregates by the cut-off.

The present invention provides for the screening of fines from the solid fragments, as usual and then forming them into aggregates or compacts and discharging them into a hopper 30 at the retorting plant. From hopper 30 they are removed by a conveyor 31 and transported over a roller screen 32 for the removal of any fines that may then be present, and, as shown in FIGS. 1 and 2 these fines and fragments may be returned to the agglomeration facility by conveyor 21 for processing along with incoming fines from the crushing operation.

From the roller screen the agglomerates are discharged into a hopper or feed chute 33 that is substantially the full width, or for practical purposes, of a width that spans the greater portion of the width of the travelling grate. This chute funnels the formed aggregates into a series of inclined, spaced, generally parallel tubes or pipes 25, the lower terminals of which are inside the sized shale bin 10*a* at spaced intervals from one another but generally in that area of the hopper where the choke-feed is generating movement of the fragments in adjusting and realigning their positions to enter the choke-feed, so that the agglomerates gravitate into and scatter through the solid fragments where the fragments moving down and they are largely bridging the gaps into which the fragments adjust themselves particularly since the agglomerates are preferably smaller than the fragments, of the order of one-half the average size of the fragments and of a uniform shape and size. Distributed in this manner through the harder, stronger pieces of shale, it has been found that the agglomerates survive very well with little breakage as the mass moves under the first cut-off plate 23. Breakage such as to significantly impair the effective flow of hot gases through the bed is avoided. Once delivered onto the grate there is little churning and shifting of the mixed bodies, even when the second layer of fragments from bin 10*b*, having no agglomerates mixed therewith is loaded onto the first layer.

Since the fines in the crushed shale which may be agglomerated may vary from 6 to 8% up to 25to 50% by weight of the total raw shale feed stream, the effective agglomeration and distillation of the fines contributes importantly to the total recovery of oil from the overall retorting of the entire tonnage of shale that is mined.

Process conditions generally fall within but are not limited to the following:

Broken Solids $6'' \times \frac{1}{8}''$ preferably $2'' \times \frac{1}{4}''$
Agglomerates $2'' \times \frac{1}{4}''$ preferably $1'' \times \frac{3}{8}''$
Bed Depth $2'' \times 10''$ preferably $4'' \times 5''$ As previously indicated, the invention is desirably practiced with two or more sizes of shale with a bin, as 10*a* and bin 10*b*, for each separate category, and in some cases the feed pipes for the agglomerates may be in a bin other than the first one or distributed among two or more supply bins.

I claim:

1. The method of heat processing hard solid fragments and fragile agglomerates on a travelling grate on which they both repose during processing which comprises:

(a) accumulating and continuously feeding the hard fragments into a bin and continuously discharging them from the bin in which they are accmulated onto a travelling grate through a choke-feed forming the bottom of the bin;

(b) feeding fragile agglomerates into a bin and continuously discharging the fragile agglomerates through a plurality of separate conduits, each having a discharge terminal in spaced relation to one another below the surface of the accumulated mass of fragments in the bin but at a level above the level of discharge of the fragments from the bin onto the travelling grate to effect the gradual separation and scattering of the agglomerates through the fragments before they are on the grate but where gradual relative shifting motion of the fragments with respect to one another as they move downward toward the grate provides for the easy diffusion of the agglomerates through the fragments before the mixture comes to rest on the travelling grate.

2. The process defined in claim 1 in which the discharge of the feed conduits for the agglomerates have their terminals near the level of the top of the choke-feed portion of the bin, with the discharge terminal thereof inclined in the direction of travel of the grate.

3. The process defined in claims 1 or 2 in which the average size of the agglomerates is smaller than the average size of the fragments and the volume of fragments is larger than the bulk volume of agglomerates in the mixture.

4. The process defined in claim 1 wherein the material subjected to heat processing comprises oil shale and wherein the oil shale is continuously crushed to fragments of varying size and fines too small to be processed with the fragments on travelling grate, separating the fragments and the fines, feeding the fragments from which the fines have been removed into a bin arranged to continuously load the fragments onto an endless travelling grate, agglomerating the fines into formed compacts which are relatively fragile as compared to the fragments, and continuously discharging the compacts into the mass of fragments in the bin below the level where the fragments are being continuously fed into the bin but at a level above their discharge onto the grate at spaced locations in the bin whereby the compacts diffuse through the moving and churning fragments as the compacts and fragments moved together downwardly and onto the grate in a manner to minimize impact and crushing stresses on the compacts.

5. The process defined in claim 4 in which the average size of the fragments is of the order of twice the size of the compacts.

* * * * *